US007074101B2

(12) United States Patent
Adachi et al.

(10) Patent No.: US 7,074,101 B2
(45) Date of Patent: Jul. 11, 2006

(54) METHOD FOR MANUFACTURING PLASMA DISPLAY PANEL

(75) Inventors: Daisuke Adachi, Kyoto (JP); Keisuke Sumida, Osaka (JP); Hideki Ashida, Osaka (JP); Morio Fujitani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 86 days.

(21) Appl. No.: 10/485,414

(22) PCT Filed: Apr. 2, 2003

(86) PCT No.: PCT/JP03/04197

§ 371 (c)(1),
(2), (4) Date: Jan. 30, 2004

(87) PCT Pub. No.: WO03/085689

PCT Pub. Date: Oct. 16, 2003

(65) Prior Publication Data

US 2004/0242113 A1 Dec. 2, 2004

(30) Foreign Application Priority Data

Apr. 4, 2002 (JP) ..... 2002-102358

(51) Int. Cl.
*H01J 9/24* (2006.01)

(52) U.S. Cl. ..... 445/24; 445/25; 427/77; 216/97

(58) Field of Classification Search ..... 445/24, 445/25; 313/582–586, 293–304, 495–497, 313/492; 427/273, 58–126.6; 216/83–109
See application file for complete search history.

(56) References Cited

U.S. PATENT DOCUMENTS

| | | | | | |
|---|---|---|---|---|---|
| 3,922,179 | A | * | 11/1975 | Weekers | 428/472.1 |
| 4,491,500 | A | * | 1/1985 | Michaud et al. | 216/87 |
| 5,192,582 | A | * | 3/1993 | Liedke et al. | 228/206 |
| 5,909,083 | A | * | 6/1999 | Asano et al. | 313/584 |
| 6,086,441 | A | * | 7/2000 | Akiguchi et al. | 445/24 |
| 6,294,722 | B1 | * | 9/2001 | Kondo et al. | 136/244 |
| 6,361,390 | B1 | * | 3/2002 | Sreeram et al. | 445/24 |

FOREIGN PATENT DOCUMENTS

| | | | |
|---|---|---|---|
| JP | 64-45037 | | 2/1989 |
| JP | 10-255669 | * | 9/1998 |
| JP | 11-246238 | | 9/1999 |
| JP | P2000-226233 A | | 8/2000 |

* cited by examiner

*Primary Examiner*—Joseph Williams
*Assistant Examiner*—Anthony Canning
(74) *Attorney, Agent, or Firm*—McDermott Will & Emery LLP

(57) ABSTRACT

A method of manufacturing a plasma display panel, whose glass substrate is not tinged and luminance is high, is provided, even when silver material is used. A layer including silver compounds, which include sulfur generated on a surface of an electrode by reacting on sulfur in air, is removed before a forming process of a dielectric layer. Then decomposition of the compound is restricted in a firing process of the dielectric layer. Even when the electrode having the silver material with high electrical conductivity is used, yellow coloration on the glass substrate is prevented. As a result, a high quality plasma display panel which does not decrease in luminance is provided.

10 Claims, 5 Drawing Sheets

METHOD FOR MANUFACTURING PLASMA DISPLAY PANEL

TECHNICAL FIELD

The present invention relates to a method of manufacturing a plasma display panel used as a display device or the like, and more particularly to a manufacturing method of restricting coloring of a glass substrate, on which an electrode containing silver is formed, produced by a float process and improving a production yield of the plasma display panel.

BACKGROUND ART

Expectations for a display apparatus using a plasma display panel (hereinafter referred to as a "PDP"), which displays an image of high definition TV as a large screen, has been rising.

The PDP is basically formed of a front plate and a rear plate. The front plate is formed of a glass plate, display electrodes, a dielectric layer and a protective layer made of MgO. The display electrode, which is formed of a striped transparent electrode and a striped bus electrode, is disposed on one surface of the glass substrate. The dielectric layer covers the display electrodes and works as a capacitor. The protective layer covers the dielectric layer.

A glass produced by a float process (hereinafter referred to as a "float glass") is used as the glass substrate, because a flat and large glass is easy to be produced by the float process. The transparent electrode is formed on the glass substrate by a thin film process, and paste including silver material is applied on the transparent electrode in a certain pattern for securing electrical conductivity. Then the paste is fired so as to form the bus electrode. In addition, paste for a light shielding layer is applied in a certain pattern and fired for improving contrast. Dielectric layer paste is applied in a manner to cover these whole electrodes and fired. Finally, the protective layer made of MgO is formed by a well-known thin-film-forming method.

On the other hand, the rear plate is formed of a glass substrate, address electrodes, a dielectric layer, barrier ribs and a phosphor layer. The address electrodes are disposed on a surface of the glass substrate in a striped pattern. The dielectric layer covers the address electrodes, and the barrier ribs are disposed thereon. The phosphor layer is formed between the barrier ribs, and emits red, green or blue light.

The front plate and the rear plate are faced and stuck each other on their electrode surfaces. Discharge gas such as Ne-Xe is sealed into discharge space formed with the barrier ribs at pressure of 400 Torr—600 Torr. The discharge gas is discharged by selectively applying a video signal to the display electrode, whereby an ultraviolet light is generated and excites the phosphor layer. As a result, red, green and blue light are emitted, thereby displaying a color image.

Japanese Patent Unexamined Publication No. H10-255669 or H11-246238 discloses that when a float glass is used as a front plate and an electrode including silver material is formed thereon, a colored layer is formed on a surface of the float glass, so that the float glass is tinged with yellow.

A phenomenon in which the float glass colors by the silver electrode is considered as follows: Silver colloid is generated by an oxidation-reduction reaction of silver ion ($Ag^+$) and reducing tin (Sn) which exist on the float glass, whereby light absorption is caused at approximately from 350 nm to 450 nm of wavelength.

In other words, the float glass is subjected to a hydrogen atmosphere in its producing process, so that a reduced layer having a thickness of several microns is generated on the surface of the float glass, and tin ions ($Sn^{++}$) resulted from melted tin (Sn) are existed therein. Silver ions ($Ag^+$) leave from the bus electrode by heat generated at a process in which the bus electrode made of silver (Ag) is formed on the glass substrate via the transparent electrode. These silver ions ($Ag^+$) diffuse on the transparent electrode and reach the surface of the glass substrate, and ion-exchange occurs with ions of alkali metal included in the glass substrate, so that the silver ions ($Al^+$) penetrate into the glass substrate. The penetrated silver ions ($Ag^+$) are reduced by tin ions ($Sn^{++}$) existed in the reduced layer, and form metal silver colloid (Ag). The glass substrate is tinged with yellow by the silver colloid (Ag). The float process is suitable to produce a glass substrate used at a large-sized display device such as the PDP, however, the glass substrate is produced on melted tin (Sn), so that tin (Sn) is inevitably stuck into the glass substrate.

Yellow coloration of the glass substrate mentioned above sometimes causes a serious damage for the large-sized display device such as the PDP. That is because luminance of a blue color decreases by coloring of the glass substrate, and chromaticity changes. Particularly, in displaying a white color, a color temperature or the like is reduced, so that picture quality deteriorates. In addition, the whole display area of the PDP looks yellowish, so that a commercial value falls. Japanese Patent Unexamined Publication No. H10-255669 discloses the following technology: Coloring, which is caused by using the electrode containing silver, of the glass substrate is restricted by abrading a surfaced of an electrode of the glass substrate and removing the reduced layer formed thereon. Using this technology, a glass substrate, which is not colored much, can be produced. However, a process of removing the surface of the electrode is needed for manufacturing processes of the glass substrate of the PDP, so that productivity is a problem to be solved.

The present invention is directed to provide a method of manufacturing a plasma display panel which can restrict the coloring (yellow coloration) of the glass substrate caused by silver ions ($Ag^+$), when the electrode is formed on the float glass by using material containing silver (Ag).

SUMMARY OF THE INVENTION

A method of manufacturing a plasma display panel (PDP) of the present invention is directed to solve the problems discussed above, and includes the following steps:

an electrode forming step of forming an electrode pattern, which contains silver material, on a glass substrate produced by a float process, a surface removing step of removing a surface layer of the electrode pattern, a dielectric layer forming step of forming a dielectric layer on a surface of the glass substrate including the electrode pattern, a protective layer forming step of forming a protective layer on the dielectric layer.

Using this method, a silver compound including sulfur (e.g., silver sulfide ($Ag_2S$) or silver sulfite ($Ag_2SO_3$)), which is generated on the surface layer of the electrode pattern by reacting on a sulfur compound in the atmosphere, can be removed before forming of the dielectric layer. As a result, decomposition of these compounds can be restricted in a firing process of the dielectric layer.

DETAILED DESCRIPTION OF THE PREFERRED EMBODIMENT

The exemplary embodiment of the present invention is demonstrated hereinafter with reference to the accompanying drawings.

Figure 1:
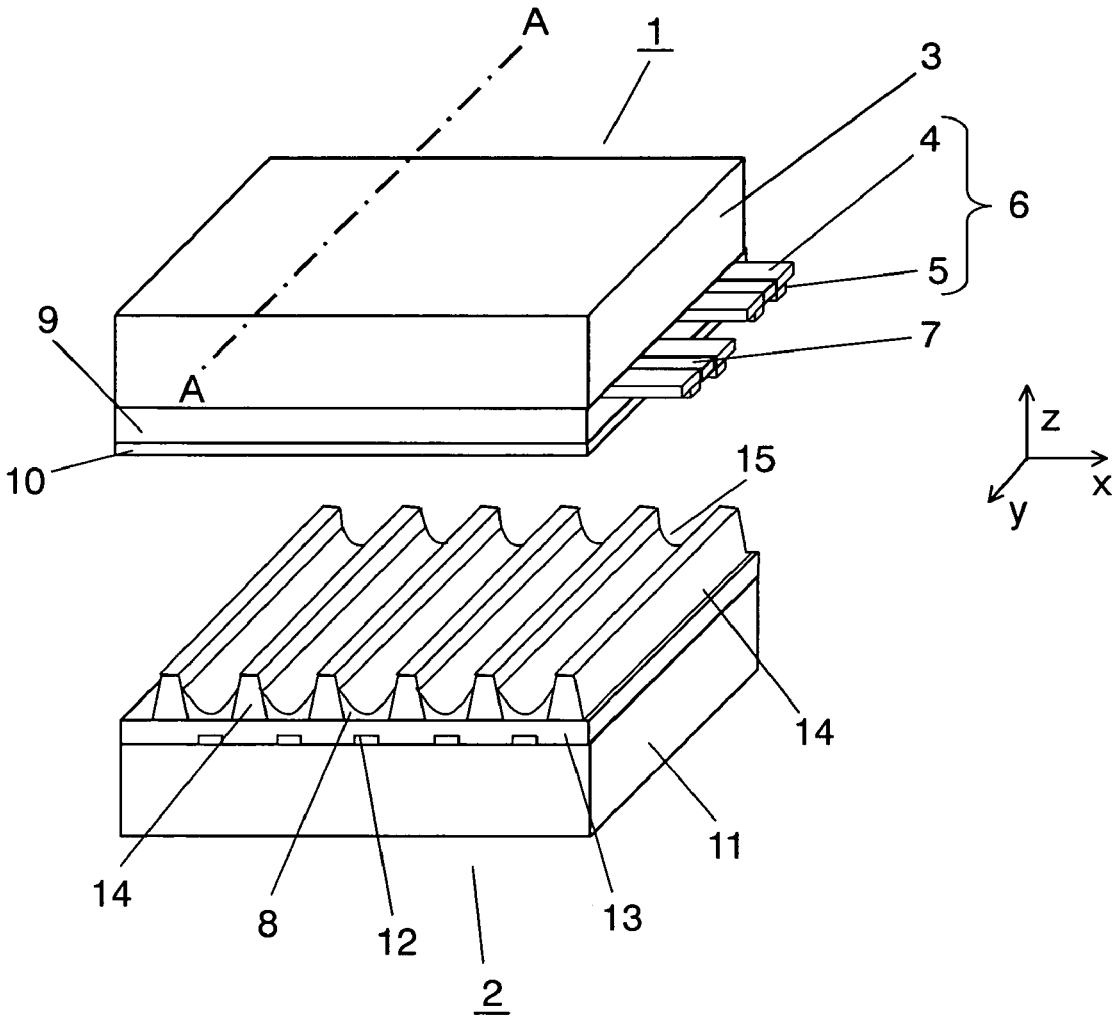
FIG. 1 is a perspective view showing a main structure of a plasma display panel (PDP).

FIG. 1 is a perspective view showing a main structure of a plasma display panel (PDP). In FIG. 1, z direction corresponds to a direction of a thickness of the PDP, and xy plane corresponds to a plane parallel to a surface of the PDP.

Figure 2:
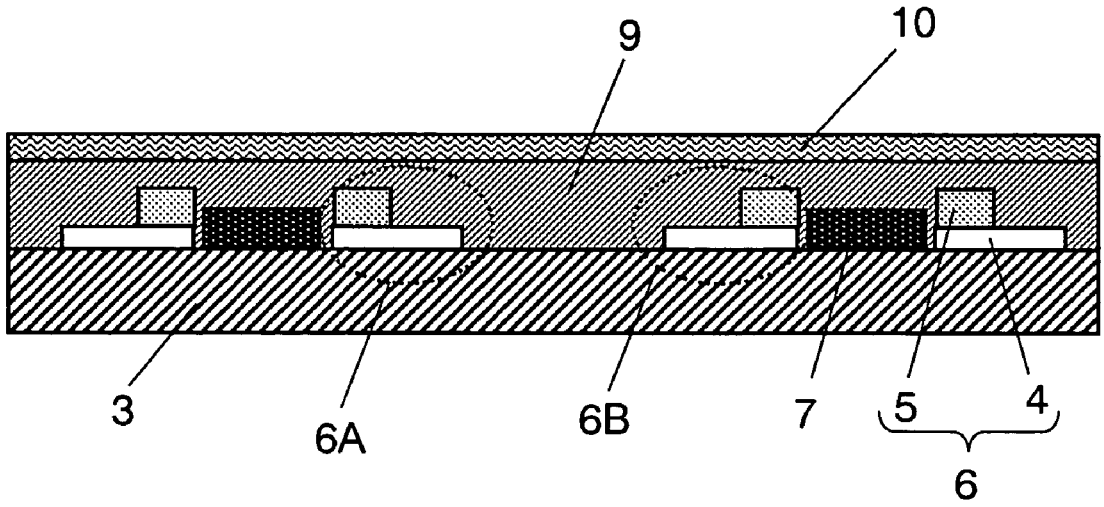
FIG. 2 is a sectional view of FIG. 1 taken along the line A—A.

FIG. 2 is a sectional view of FIG. 1 taken along the line A—A.

As shown in FIG. 1, the PDP is formed of front plate 1 and rear plate 2, both of which are oppositely disposed. Striped transparent electrodes 4 are formed facing rear plate 2 and parallel to each other on front glass substrate 3 of front plate 1, where a direction of the length of electrodes 4 corresponds to x direction. As shown in FIG. 2, bus electrode 5, which is narrower and has higher electrical conductivity than transparent electrode 4, is disposed on transparent electrode 4 so as to form display electrode 6. Bus electrode 5 is formed on one margin of an odd-numbered transparent electrode 4 along the direction of the length thereof. Bus electrode 5 is also formed on the other margin of an even-numbered transparent electrode 4 along the direction of the length thereof Light shielding layer 7 is formed between adjacent display electrodes 6 and near sides where bus electrodes 5 are disposed. Light shielding layer 7 is used for shielding white reflected from phosphor layer 8 to improve contrast in a non-emitting period.

Dielectric layer 9 covers a surface of front glass substrate 3 on which display electrode 6 and light shielding layer 7 are disposed. Protective layer 10 is formed on the whole area of dielectric layer 9.

One display pixel is formed of display electrode 6A and display electrode 6B, which are display electrodes 6 disposed between adjacent light shielding layers 7.

Address electrodes 12 are formed facing front plate 1 and parallel to each other on rear glass substrate 11 of rear plate 2, where a direction of the length of address electrodes 12 corresponds to y direction. In addition, dielectric layer 13 of the rear plate is formed covering address electrodes 12. Striped barrier rib 14 is formed on dielectric layer 13 in a manner to be positioned above an area between address electrodes 12. Phosphor layers 8, which each emit red, green or blue light, are regularly placed on striped concave sections formed of barrier ribs 14 and dielectric layer 13.

As shown in FIG. 1, front plate 1 and rear plate 2 are positioned in a manner that address electrode 12 and display electrode 6 face each other crossing at right angles. Discharge gas is filled in space surrounded by striped concave sections, which are formed of barrier ribs 14 of rear plate 2 and dielectric layer 13, and protective layer 10 of front plate 1. Outer peripheries of front plate 1 and rear plate 2 are sealed with sealing glass.

Discharge space 15 is formed between adjacent barrier ribs 14. Specifically, as shown in FIG. 2, an area where a pair of adjacent display electrodes 6A and 6B cross over address electrode 12 forms discharge space 15, namely, a cell where an image is displayed. Discharge gas (filled gas) composed of rare gases such as He, Xe or Ne is sealed into discharge space 15 at pressure of approximately 400 Torr to 600 Torr.

In driving the PDP, a ultraviolet light with wavelengths of approximately 147 nm is generated by discharge between address electrode 12 and display electrode 6 or between a pair of display electrodes 6A and 6B, so that phosphor layers 8 emits light and an image is displayed.

Figure 3:
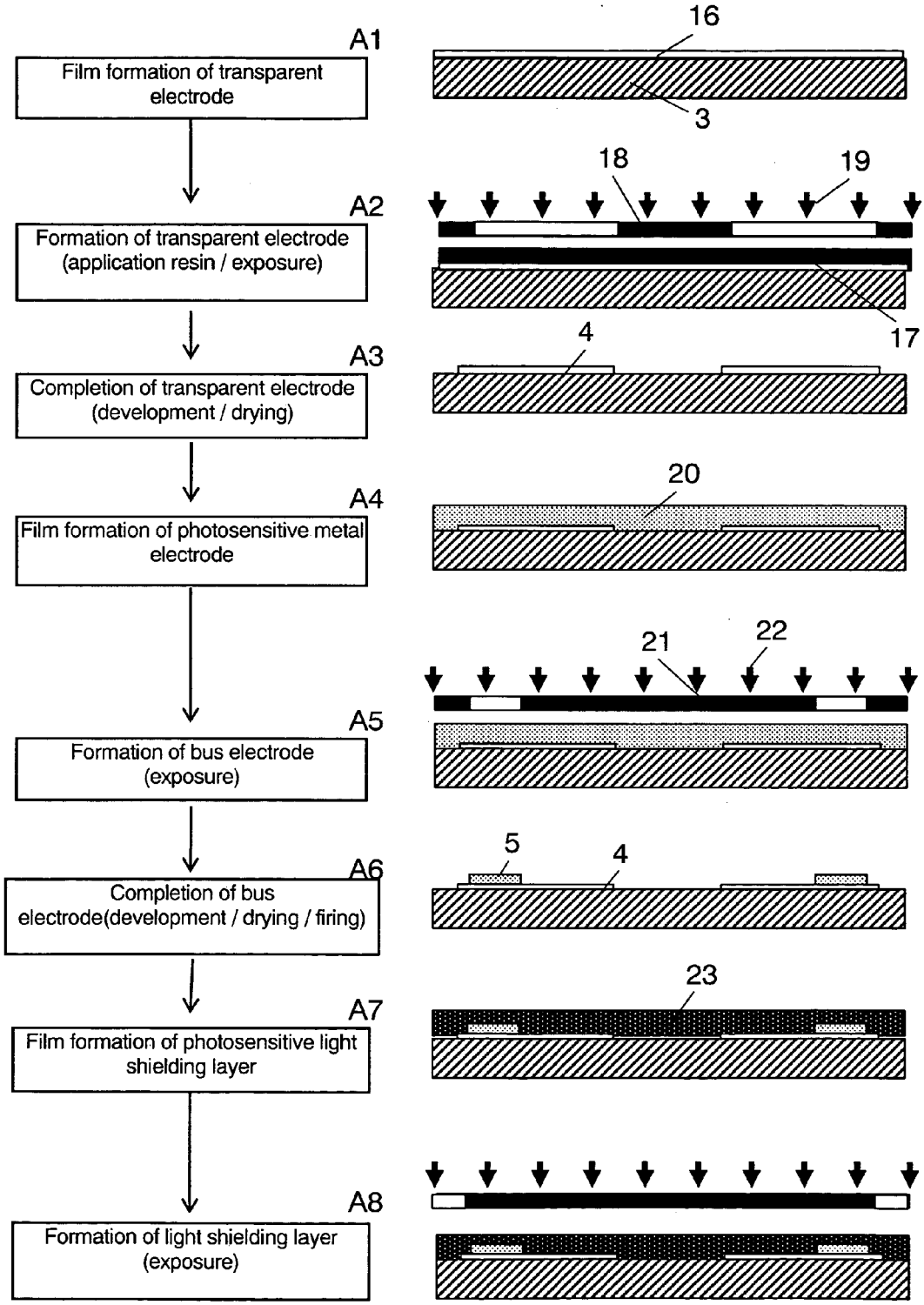
FIG. 3 is a flow chart showing processes till an exposure process of forming a light shielding layer in accordance with an exemplary embodiment of the present invention.
Figure 4:
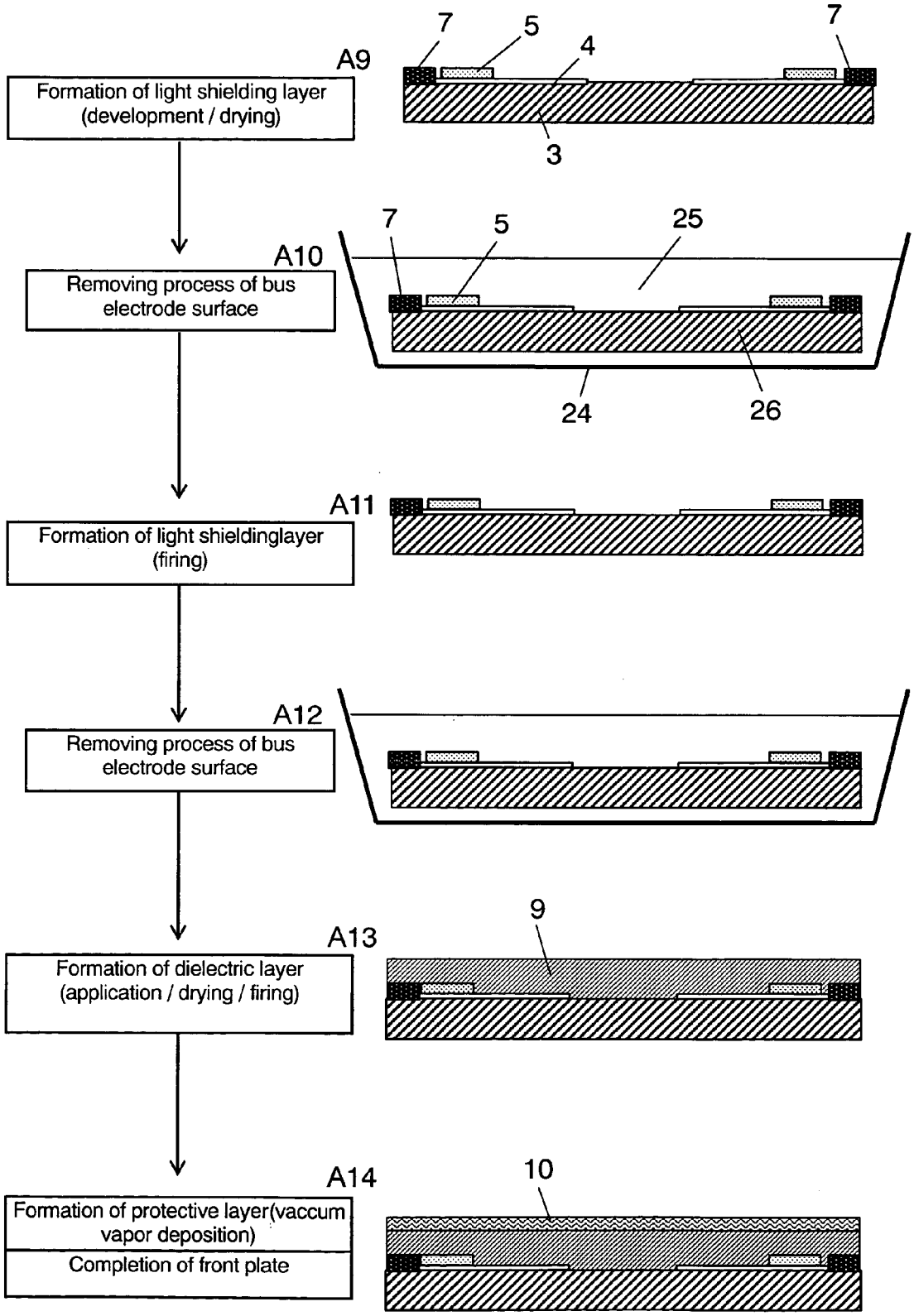
FIG. 4 is a flow chart showing processes till a process of forming a protective layer in accordance with the exemplary embodiment of the present invention.

A method of manufacturing front plate 1 of the present embodiment is specifically demonstrated hereinafter. FIG. 3 and FIG. 4 are schematic flow charts showing an example of manufacturing processes of electrodes and the front plate of the PDP using the electrodes in accordance with the exemplary embodiment of the present invention. FIG. 3 shows halfway processes of forming light shielding layer 7 of front plate 1, and FIG. 4 shows processes after that.

In first process A1 of FIG. 3, film 16 for a transparent electrode made of ITO, tin oxide ($SnO_2$ ) or the like is uniformly formed on front glass substrate 3, which is produced by a float process, by using a sputtering method.

In process A2, film 16 is formed in a specific pattern using a photolithography method so as to form transparent electrode 4. Positive resist 17 whose principal ingredient is novolac resin is applied with a thickness of 1.5 μm to 2 μm. Then positive resist 17 is exposed and hardens by an ultraviolet light using photomask 18 which has a specific pattern. Light source 19 of the ultraviolet light is an ultra-high pressure mercury lamp, and its light volume is approximately 300 mJ /$cm^2$. After that, substrate 3 is developed with alkali solution, so that a resist pattern is formed.

In process A3, substrate 3 is immersed in solution whose principal ingredient is hydrochloric acid, and film 16 is etched to remove an unnecessary portion. Then, the resist is removed and patterned transparent electrode 4 is formed after a drying process.

In process A4, film 20 for a metal electrode is formed on transparent electrode 4. In this process, electrically conductive material containing silver (Ag), glass frit of PbO—$B_2O_3$—$SiO_2$ base or $Bi_2O_3$—$B_2O_3$—$SiO_2$ base or the like, polymerization initiator, photo-setting monomer and negative photosensitive paste containing organic solvent or the like are used as material. A screen printing method or a green sheet method is used for forming film 20. When the screen printing method is used, a drying process is needed after a screen process.

In process A5, film 20 is formed in a specific pattern, so that bus electrode of the display electrode is formed. Exposed areas of film 20 harden by irradiating an ultraviolet light using photmask 21 which has a specific pattern. Light source 22 of the ultraviolet light is an ultra-high pressure mercury lamp, and its light volume is approximately 300 mJ /$cm^2$.

In process A6, film 20 is developed with alkali developer (e.g., sodium carbonate solution of 0.3 wt %) so as to form a pattern. After drying, film 20 is fired at not lower than a softening point temperature of glass frit in air, so that bus electrode 5, which is made of silver material and has high electrical conductivity, is fixed on transparent electrode 4 formed on front glass substrate 3.

According to the present embodiment, bus electrode 5 is demonstrated as a one-layer electrode. However, a black electrode can be formed on transparent electrode 4, and bus electrode 5 made of silver material can be formed thereon to improve contrast.

In process A7, film 23 for the light shielding layer is formed for restricting reflection of white light, which is emitted from phosphor layer 8 of rear plate 2 and leaks from between bus electrodes 5, to improve contrast. In this process, nagative photosensitive paste containing black pigment, glass frit of $PbO—B_2O_3—SiO_2$ base or $Bi_2O_3—B_2O_3—SiO_2$ base or the like, polymerization initiator, photo-setting monomer and solvent or the like are used as material. Metallic oxide pigment containing two or more kinds of metallic oxide selected from the group of copper (Cu) oxide, iron (Fe) oxide, chrome (Cr) oxide, manganese (Mn) oxide, cobalt (Co) oxide is used as the black pigment. A screen printing method or a green sheet method is used for forming film 23. When the screen printing method is used, a drying process is needed after a screen printing process.

In process A8, light shielding layer 7 is formed. This process is a similar exposing process to process A5 for forming the silver electrode. Conditions such as exposing illumination are different, however, the method is the same, so that descriptions are omitted here.

Next processes are described hereinafter with reference to FIG. 4. FIG. 4 demonstrates processes after the processes of FIG. 3. In process A9, substrate 3 is developed with alkali developer and dried so as to form a pattern of light shielding layer 7.

Silver ions ($Ag^+$) cause coloring (yellow coloration) of the glass substrate. Silver ion exists as silver compounds including silver oxide ($Ag_2O$) and sulfur (e.g., silver sulfide ($Ag_2S$) or silver sulfite ($Ag_2SO_3$)), both of which are generated on a surface of the electrode. When these silver compounds are decomposed in the firing process, silver ions ($Ag^+$) are removed from the electrode. These silver ions ($Ag^+$) diffuse on the transparent electrode and reach the surface of the glass substrate, and ion-exchange occurs with sodium ion ($Na^+$) or the like in the glass substrate, so that the silver ions ($Ag^+$) penetrate into the glass substrate. The penetrated silver ions ($Ag^+$) are reduced by tin ions ($Sn^{++}$) existed in a reduced layer, and form metal silver colloid (Ag), so that the surface of the glass substrate colors.

As discussed above, compounds of silver (Ag) and oxygen or sulfur in air are formed from process A6, in which bus electrode 5 is formed, to the process, in which light shielding layer 7 is formed and dried. The present embodiment provides process A10 for aiming to remove silver compounds including sulfur formed on the surface of the electrode and.

In process A10, silver compounds including sulfur formed on the surface of bus electrode 5 are removed. Front plate 26, on which bus electrode 5 and light shielding layer 7 after the drying process are formed, in process is immersed in treatment solution 25 of tank 24. Treatment solution 25 contains sodium hydrogen carbonate solution of 2 wt %, in which aluminum (Al) of 0.1 wt % is dissolved, at a temperature of 80° C. Using this process, silver compounds including sulfur generated on the surface of bus electrode 5 are removed. After that, silver ions ($Ag^+$), sodium ions ($Na^+$) and the like which remain on the substrate are removed by washing. At this time, the silver compounds including sulfur generated on the surface of bus electrode 5 are removed by a reduction reaction of silver ions and aluminum ions. In the present embodiment, an aluminum metal is used, however, other metals having ionization tendency lower than silver (Ag) can be used.

Besides, in this embodiment, sodium hydrogen carbonate solution of 2 wt %, in which aluminum (Al) is dissolved, at a temperature of 80° C. is used for removing the silver compounds including sulfur generated on the surface of bus electrode 5. However, heating front plate 26 in process in a reducing atmosphere such as hydrogen ($H_2$) or a mechanical method such as a buffing can be used for removing the silver compounds. In short, this invention is not limited to the present embodiment. When the buffing is used for removing the silver compounds, the silver compounds can be removed by removing a surface of the electrode till approximately 20 nm in depth at an ordinary temperature and pressure in an atmospheric environment. The depth for removing the silver compounds varies according to an environmental condition. As discussed above, the silver compounds including sulfur can be removed without damaging other constituent components by using the easy mechanical abrading method.

In process A11, light shielding layer 7 after removing the silver compounds including sulfur on the surface of bus electrode 5 is fired. Because the silver compounds including sulfur are removed in previous process A10, a state in which the silver compounds are discomposed and change into silver ions ($Ag^+$) does not exist in this firing process. Therefore, the silver ions ($Ag^+$) do not penetrate into the glass substrate, because the silver ions ($Ag^+$) do not diffuse in transparent electrode 4 and reach the surface of the glass substrate, and ion-exchange does not occur with sodium ion ($Na^+$) or the like in the glass substrate. As a result, the surface of the glass substrate does not color, because the silver ions ($Ag^+$) are not reduced by tin ions ($Sn^{++}$) existed in a reduced layer, and do not form metal silver colloid (Ag).

After forming light shielding layer 7, dielectric layer 9 and protective layer 10 are formed so as to complete front plate 1. However, if front glass substrate 3 is left in atmospheric air till dielectric layer 9 is formed, a sulfur compound is generated on the surface of bus electrode 5. When a time interval till the forming of dielectric layer 9 is short in a product line, the generation of the sulfur compound is restricted. However, the time interval which can prevent coloring is approximately one or two hour. Therefore, in the present embodiment, a bus-electrode-surface-removing process is also provided in process A12. Process A12 is the same as process A10, so that descriptions are omitted here.

In process A13, dielectric layer 9 is formed. Paste containing dielectric glass powder is applied on the whole display area by using a screen printing method. After that, solvent is removed from the applied paste in an infrared drying process at 100° C. for 10 minutes. When desirable thickness is not obtained by one printing of the screen printing method, the dielectric layer with desirable thickness is formed by repetitive printing and drying processes. Then the paste is fired at approximately 600° C., thereby forming dielectric layer 9. A thickness of dielectric layer 9 is approximately 30 μm.

In process A14, protective layer 10 is formed. Protective layer 10 made of MgO is uniformly formed on the substrate with a thickness of 600 nm by using an electron beam deposition method, so that front plate 1 is completed. The PDP is completed by bonding front plate 1 with rear plate 2.

In the present embodiment, the process of removing the silver compounds, which include sulfur generated on the surface of bus electrode 5 made of silver material, is provided at two times, namely, before the firing process of the light shielding layer and before the forming process of the dielectric layer. However, a certain effect of restricting coloring is obtained in one step of removing the silver compounds before the forming process of the dielectric layer. In short, coloring is restricted by removing the compounds, which are generated by a reaction between bus electrode 5 and sulfur existing in the environment, before the firing process in which the compounds are decomposed.

Figure 5:
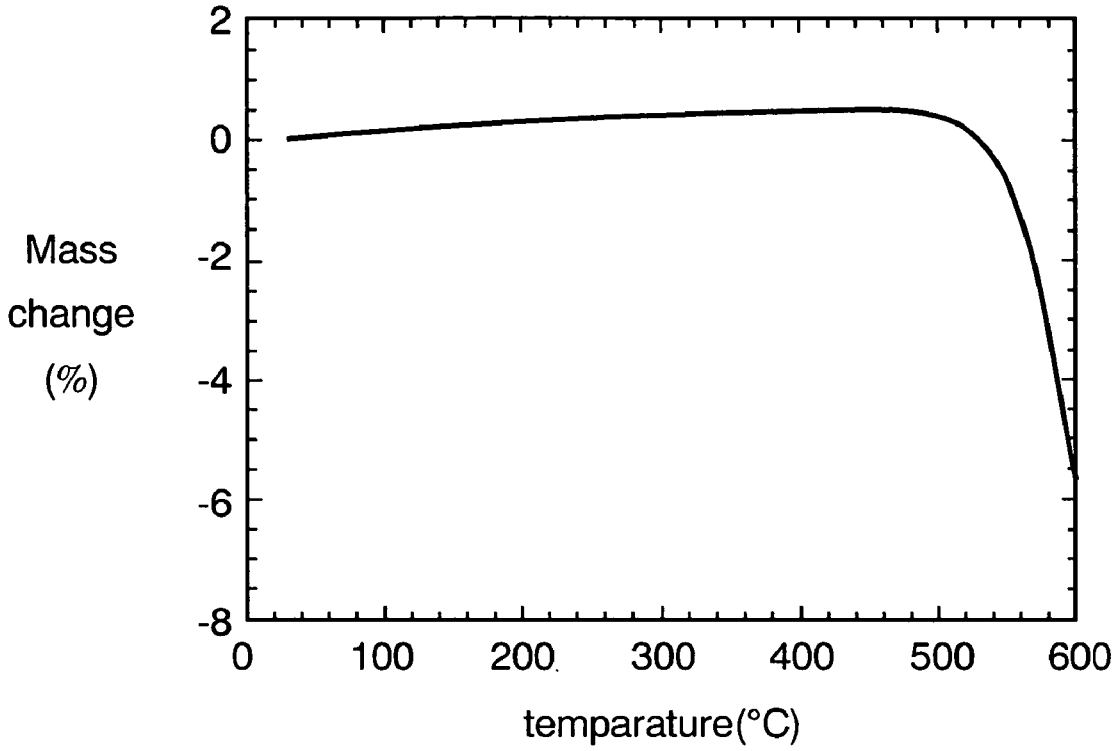
FIG. 5 is a characteristic view showing thermal decomposition of $Ag_2S$.

FIG. 5 is a characteristic view showing thermal decomposition of silver sulfide ($Ag_2S$) in air. Silver sulfide ($Ag_2S$) generated on the surface of bus electrode 5 is rapidly decomposed at higher than 520° C. Therefore, in the present embodiment, decomposition of the compound is restricted and the compound is efficiently removed by performing the bus-electrode-surface-removing process at not higher than 520° C.

Table 1 shows a coloring degree and a thickness of the sulfur compound in process on the surface of bus electrode 5, and compares the processes of the present embodiment demonstrated in FIGS. 3 and 4 with conventional processes which do not have a process of removing the silver compounds including sulfur.

TABLE 1

| | the present invention | the conventional process |
|---|---|---|
| a depth where the sulfur compound is detected with Auger electron spectroscopy | not detected | 5 nm |
| a yellow coloration degree b* | 0.4 | 2.0 |

The depth where the sulfur compound is detected on Table 1 is measured by analyzing the sulfur compound of the surface of the bus electrode in depth with Auger electron spectroscopy after process A10 of FIG. 4, namely, the bus-electrode-surface-removing process of the silver compound including sulfur.

As the yellow coloration degree of the completed front plate, b* value of L*a*b* calorimetric system (CIE 1976) is measured and compared. D65 light source is used for the measurement.

As a result, in the conventional process, the silver compound including sulfur is detected till the depth of 5 nm. However, in this embodiment, a silver compound is not detected, namely, removal of the silver compound including sulfur on the surface of the electrode is confirmed. Besides, the b* value indicating the yellow coloration degree is 0.4 at the front plate of the present embodiment, however, that of the conventional process is 2.0. In other words, the yellow coloration degree of the front plate of the present embodiment is lower than that of the conventional process.

As discussed above, yellow coloration on the glass substrate is prevented by removing the silver compound including sulfur.

INDUSTRIAL APPLICABILITY

Using a method of manufacturing a plasma display panel of the present invention, yellow coloration on a glass substrate can be prevented, even when an electrode having silver material with high electrical conductivity is used. Therefore, a high quality plasma display panel, which does not decrease in luminance and has a high production yield, is provided.

The invention claimed is:

1. A method of manufacturing a plasma display panel comprising:

an electrode forming step of forming an electrode pattern, which is used for a display electrode and contains silver material, on a surface of a glass substrate produced by a float process;

a surface removing step of removing a surface layer of the electrode pattern by means of sodium hydrogen carbonate solution with dissolved metal having ionization tendency lower than silver;

a dielectric layer forming step of forming a dielectric layer on the surface of the glass substrate including the electrode pattern; and a protective layer forming step of forming a protective layer on the dielectric layer.

2. The method of manufacturing the plasma display panel of claim 1 further comprising:

a step of forming a light shielding layer and a step of firing the light shielding layer after the electrode forming step, wherein the surface removing step of removing the surface layer of the electrode pattern by means of sodium hydrogen carbonate solution with dissolved metal having ionization tendency lower than silver is performed before the step of firing the light shielding layer.

3. The method of manufacturing the plasma display panel of claim 1, wherein a silver compound including sulfur generated on the electrode pattern is removed by the surface removing step of removing the surface layer of the electrode pattern by means of sodium hydrogen carbonate solution with dissolved metal having ionization tendency lower than silver.

4. The method of manufacturing the plasma display panel of claim 3, wherein the surface removing step includes a reduction reaction of a silver ion and a metal ion having ionization tendency lower than silver.

5. The method of manufacturing the plasma display panel of claim 2, wherein a silver compound including sulfur generated on the electrode pattern is removed by the surface removing step of removing the surface layer of the electrode pattern by means of sodium hydrogen carbonate solution with dissolved metal having ionization tendency lower than silver.

6. The method of manufacturing the plasma display panel of claim 1, wherein the metal having ionization tendency lower than silver is aluminum.

7. The method of manufacturing the plasma display panel of claim 2, wherein the metal having ionization tendency lower than silver is aluminum.

8. The method of manufacturing the plasma display panel of claim 3, wherein the metal having ionization tendency lower than silver is aluminum.

9. The method of manufacturing the plasma display panel of claim 4, wherein the metal having ionization tendency lower than silver is aluminum.

10. The method of manufacturing the plasma display panel of claim 5, wherein the metal having ionization tendency lower than silver is aluminum.

* * * * *